US005402842A

United States Patent [19]

Ruggiero

[11] Patent Number: 5,402,842

[45] Date of Patent: Apr. 4, 1995

[54] SHOWER CURTAIN SUPPORT

[76] Inventor: Anthony J. Ruggiero, 7724 Summerdale Ave., Philadelphia, Pa. 19111

[21] Appl. No.: 166,309

[22] Filed: Dec. 10, 1993

Related U.S. Application Data

[63] Continuation-in-part of Ser. No. 751,100, Aug. 28, 1991, Pat. No. 5,170,974.

[51] Int. Cl.[6] ..... A47H 1/00

[52] U.S. Cl. ..... 160/330; 160/DIG. 6; 4/610

[58] Field of Search ..... 160/330, DIG. 6; 211/105.1; 4/610, 608, 558, 154, 149; 248/264, 251; 16/87.4, 94 D, 89

[56] References Cited

U.S. PATENT DOCUMENTS

| | | | |
|---|---|---|---|
| 2,219,075 | 10/1940 | Veau | 4/610 |
| 2,481,397 | 9/1949 | Dalton | 4/149 |
| 2,538,755 | 1/1951 | Bradley | 4/610 X |
| 2,554,106 | 5/1951 | Heubeck | 4/610 X |
| 2,741,923 | 4/1956 | Bradley | 4/610 X |
| 2,771,945 | 11/1956 | Wittrup | 160/124 |
| 2,778,030 | 1/1957 | Croche | 4/610 X |
| 2,878,487 | 4/1959 | Foote | 4/154 |
| 2,923,013 | 2/1960 | Wasserman | 4/610 |
| 3,418,665 | 12/1968 | Long | 4/149 |
| 3,497,905 | 3/1970 | Pflum . | |
| 3,639,919 | 2/1972 | White | 4/149 |
| 3,879,806 | 4/1975 | Armstrong | 24/73 CH |
| 3,891,091 | 6/1975 | Anderson | 248/264 X |
| 3,895,399 | 7/1975 | Giarrante | 4/149 |
| 3,934,636 | 1/1976 | Simmons | 160/349 R |
| 4,088,174 | 5/1978 | Edwards | 160/349 R |
| 4,117,557 | 10/1978 | McPeak et al. | 4/149 |
| 4,229,842 | 10/1980 | Gilmore | 4/610 |
| 4,361,915 | 12/1982 | Sienert | 4/608 |
| 4,381,578 | 5/1983 | Glejf | 248/264 X |
| 4,385,409 | 5/1983 | File et al. | 4/608 |
| 4,461,056 | 7/1984 | Solinski | 16/87.4 R |
| 4,667,353 | 5/1987 | Zeigler et al. | 4/610 |
| 4,754,504 | 7/1988 | Cellini | 4/610 |
| 4,769,862 | 9/1988 | Skrzelowski | 4/610 |
| 5,031,257 | 7/1991 | Jeffrey | 4/608 X |
| 5,170,974 | 12/1992 | Ruggiero | 248/251 |
| 5,189,759 | 3/1993 | Poore | 4/608 X |

FOREIGN PATENT DOCUMENTS 1272439 4/1991 Canada .

OTHER PUBLICATIONS

Sears Catalog, p. 923.

*Primary Examiner*—Blair M. Johnson
*Attorney, Agent, or Firm*—Volpe and Koenig

[57] ABSTRACT

A curtain corner support which is slidably supported on a curtain rod which spans an opening defined between vertical walls of an enclosure. The corner support positions an end portion of a curtain so that it is adjacent to one of the enclosure walls to prevent water, spray and/or light from escaping around the edges of the enclosure. The corner support consists of a body member which is supported by the curtain rod, a beam cantilevered from the body member which supports the end portion of the curtain, and a device for transferring the moment generated by the end portion of the curtain and the beam to the curtain rod to prevent the body member from rotating about the curtain rod. Wall attachments are affixed to at least one curtain rod end for transferring the torque from the curtain rod to at least one of the vertical walls of the enclosure to maintain the top edge of the curtain in an approximately horizontal plane.

6 Claims, 5 Drawing Sheets

SHOWER CURTAIN SUPPORT

RELATED APPLICATION

This application is a continuation-in-part of application number PCT/US92/07307 which was filed on Aug. 28, 1992, which is a continuation of U.S. Pat. application Ser. No. 07/751,100, filed on Aug. 28, 1991, now issued as U.S. Pat. No. 5,170,974, and is incorporated herein by reference as if fully set forth.

BACKGROUND OF THE INVENTION

1. Field of the Invention

The present invention is concerned with a curtain support used in combination with a curtain rod to support and extend the end portions of the curtain. More particularly, the present invention is concerned with corner supports that extend a shower curtain around gaps which are prevalent at the juncture between the shower curtain ends and the adjacent walls which define the shower enclosure to prevent shower spray from escaping the shower area. Most particularly, the present invention relates to a shower curtain corner support which extends the curtain along the adjacent wall of the shower stall and maintains the horizontal and vertical orientation of the curtain.

2. Description of the Prior Art

The present inventor's prior U.S. Pat. No. 5,170,974, which is incorporated herein by reference as if fully set forth, as well as the above-identified related application disclose the desirability of providing shower curtain supports to prevent shower spray from escaping the shower area. Both references disclose shower curtain corner supports which include a cantilevered beam, that is directed into the shower area, supported by a body carried on the curtain rod. An adjustable counter weight maintains the beam in an approximately horizontal plane.

In some applications, such as hotel or motel showers, it is desirable to have shower curtain corner supports which cannot be tampered with or misadjusted by the users. In other applications, it is desirable to have a shower curtain corner support without a counter weight for aesthetic reasons or because the counterweight could interfere with the location of a secondary curtain rod for supporting a valance in close proximity to the shower curtain rod. The corner supports must still maintain the vertical orientation of the portion of the curtain which extends along the adjacent wall of the shower enclosure, yet be insensitive to the differing weights of various shower curtain materials.

Accordingly, it is an object of the present invention to provide a corner support device which will support the end portion of the shower curtain which extends along the adjacent wall of the shower enclosure while maintaining the top edge of the shower curtain in substantially the same plane throughout the length of the shower curtain.

It is an object of this invention to provide shower curtain corner supports which resist the moment generated by the end portions of the shower curtain and maintain the horizontal or top edge of the shower curtain in a substantially horizontal plane throughout its length.

It is an object of this invention to provide tamper resistant shower curtain corner supports.

SUMMARY OF THE INVENTION

The present invention provides a curtain corner support in combination with a curtain rod which spans the opening of the enclosure. The corner support positions an end portion of the curtain adjacent to the enclosure wall. The curtain corner support is comprised of a body member which is supported by the curtain rod. A beam is cantilevered from the body member with a central portion which extends away from the body member and a free end which is generally perpendicular to the body member. The beam supports the end portion of the curtain. Moment transferring means transfer the moment generated by the end portion of the curtain and the beam to the curtain rod and prevent the body member from rotating about the curtain rod. Attachment means located at the curtain rod ends transfer the torque from the curtain rod to at least one of the vertical walls of the enclosure in order to maintain the inner beam in an approximately horizontal plane.

DETAILED DESCRIPTION OF THE PREFERRED EMBODIMENTS

The description of the preferred embodiments will be made with reference to the accompanying drawings wherein like numerals indicate like elements throughout.

Figure 1:
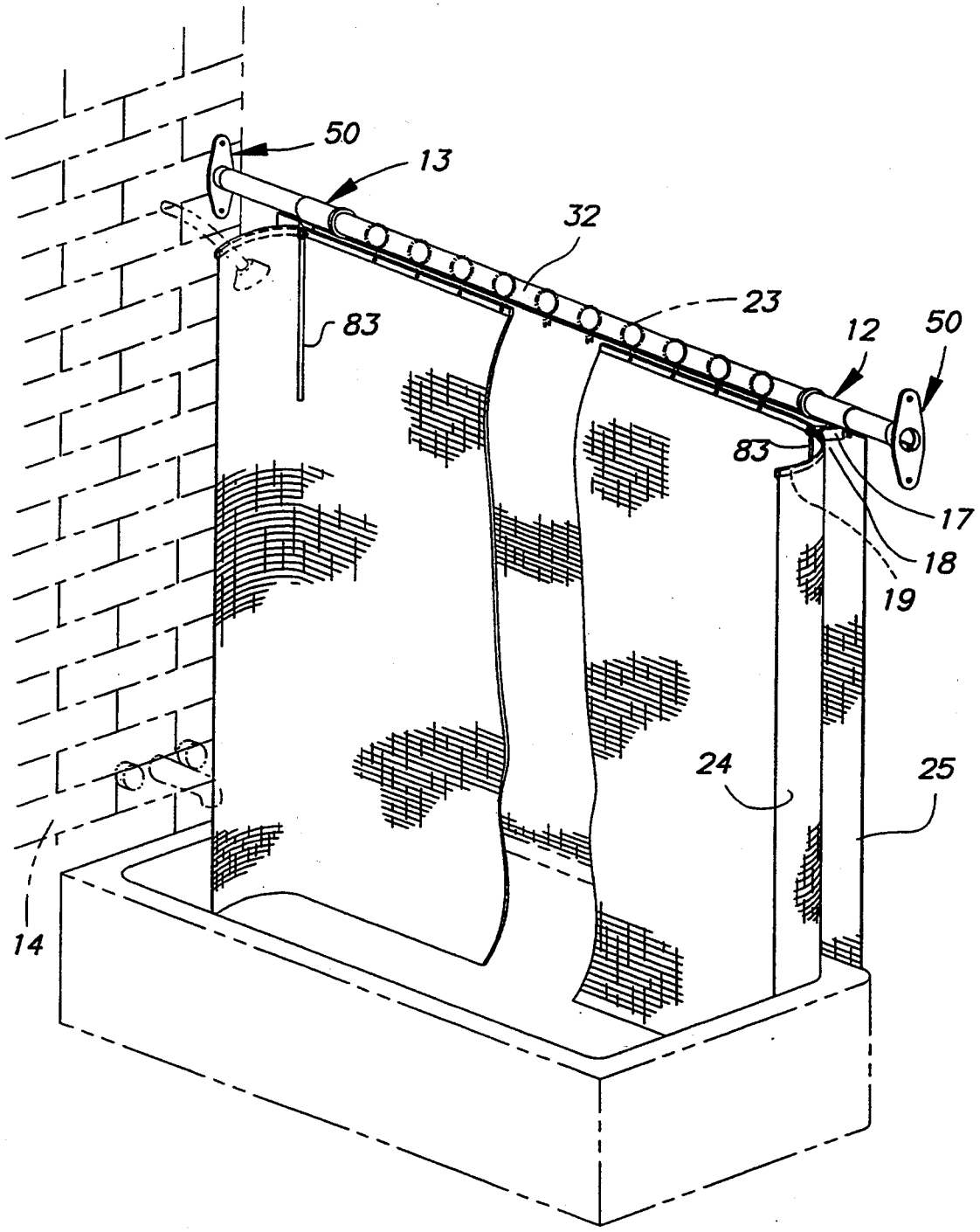
FIG. 1 is a perspective view from inside a shower enclosure showing two shower curtain corner supports in accordance with the first embodiment of the invention.

FIG. 1 shows a representative shower enclosure arrangement with a shower curtain rod 32 attached across the opening defined by two opposing vertical walls 14 on either side of a bath tub. The shower rod 32 is shown attached to the left side wall 14 by a keyed wall attachment 50. The opposite end of the shower curtain rod 32 will be attached in the same manner to a second wall, not shown. An inner liner curtain 24 and an outer decorative shower curtain 25 are suspended by hooks 23 which are slidably supported by the shower curtain rod 32. Right and left-hand shower curtain corner support devices 12 and 13 in accordance with the present invention are slidably supported by the shower rod 32. Generally, one corner support is installed at each end of the shower curtain array. As will be appreciated by those skilled in the art, the right and left-hand shower curtain corner supports 12 and 13 are opposite-hand parts; accordingly, only the right-hand corner support 12 will be described in detail.

Figure 2:
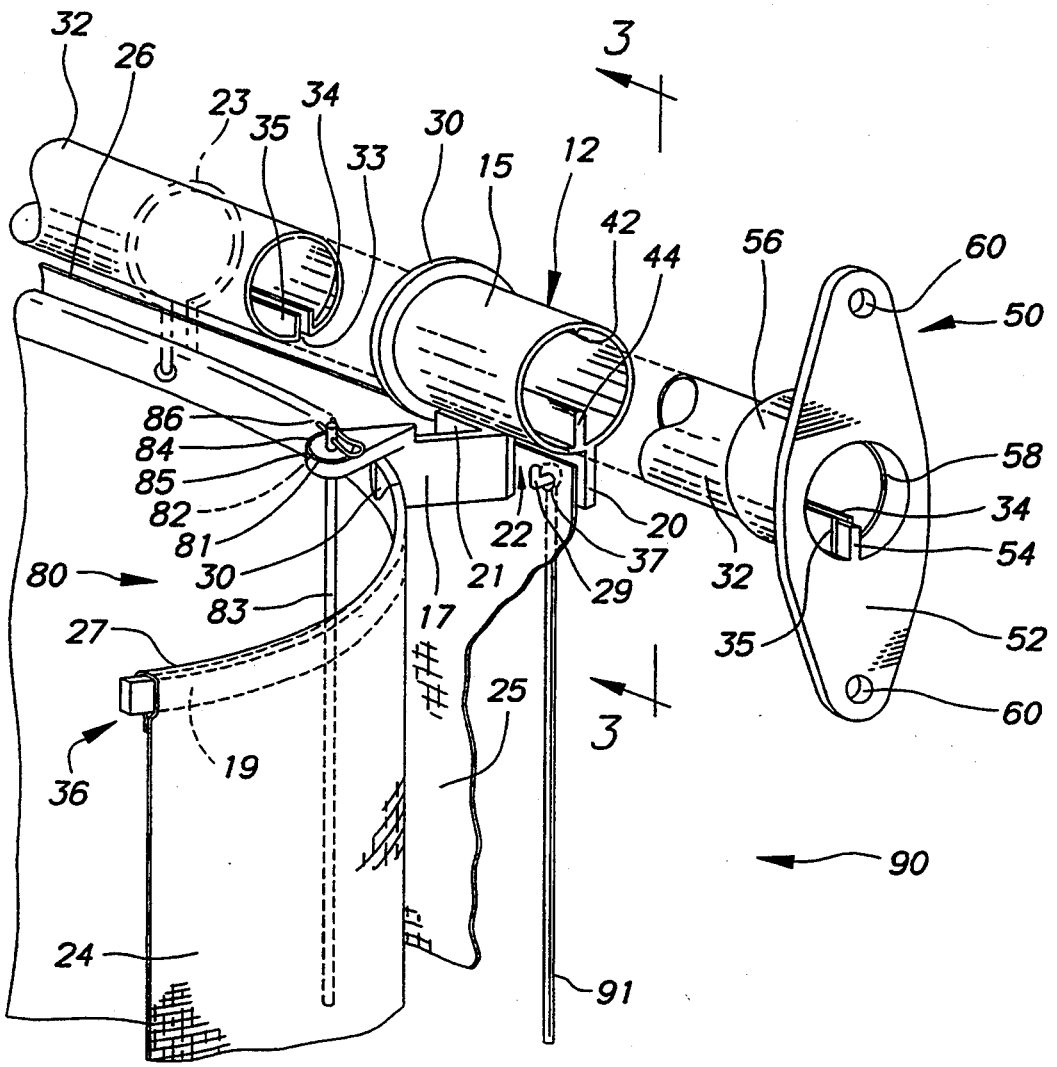
FIG. 2 is a perspective view of one corner support in accordance with the first embodiment of the invention.
Figure 3:
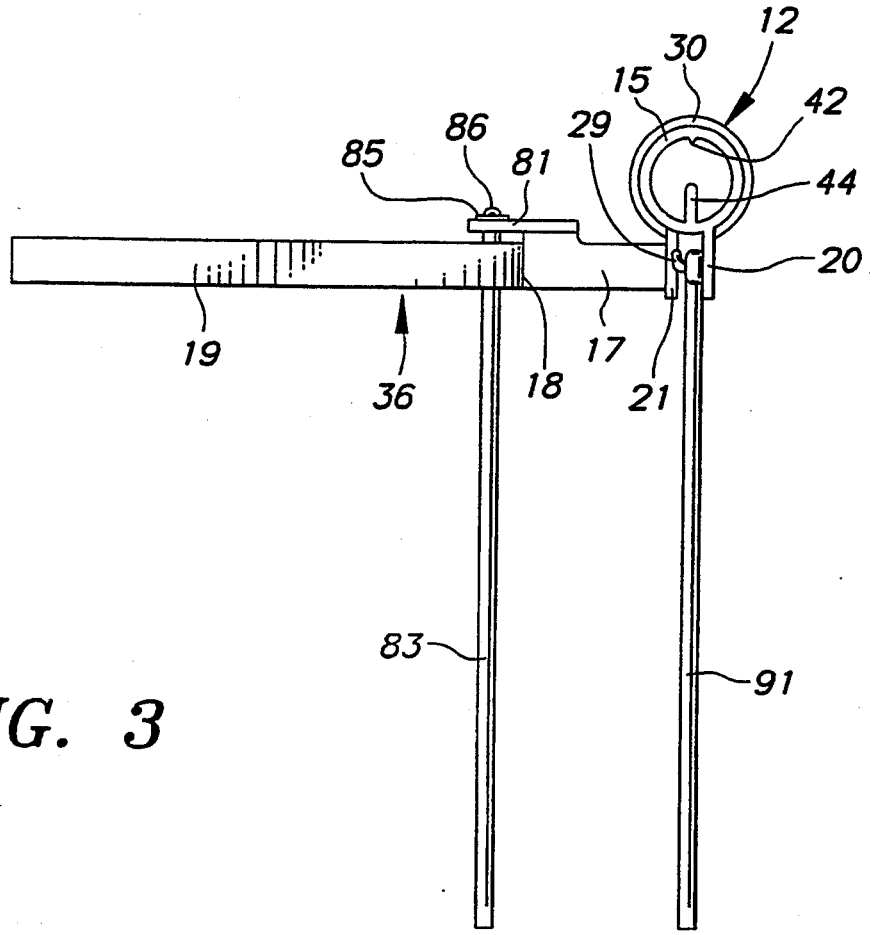
FIG. 3 is an elevation view taken along line 3—3 in FIG. 2.
Figure 4:
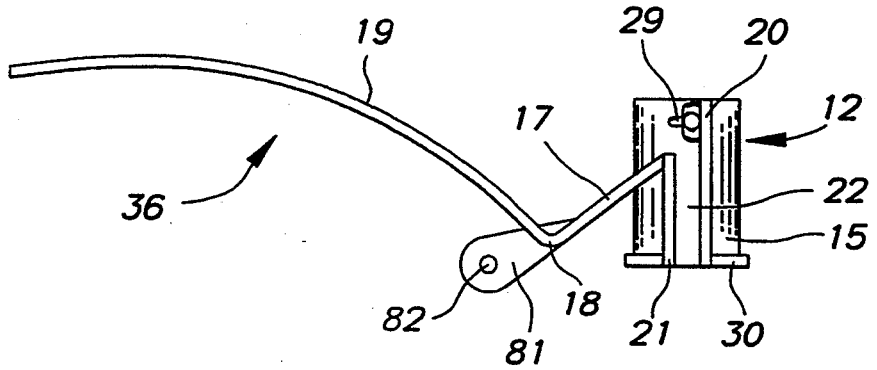
FIG. 4 is a bottom view of the first embodiment of the invention.

The first embodiment of the right-hand shower curtain corner support 12 is shown in detail in FIGS. 2-4. The corner support 12 is comprised of a hollow cylindrical body 15 which is slidably supported on the shower curtain rod 32. The shower curtain rod 32 is provided with a slot 33. A projection 44 extends into the hollow cylindrical body 15 and is complementarily keyed to the slot 33 of the shower curtain rod 32. Vertical flanges 34 and 35 extend up from the edges of slot 33 to provide a bearing surface for projection 44. A small triangular knife edge 42 extends into the cylindrical body 15 from a position generally opposite to keyed projection 44. The knife edge 42 rides along the top of the curtain rod 32 and reduces friction. In the preferred embodiment, the rod 32 is approximately 1.00 inches in diameter, the slot 33 is approximately 0.25 inches wide, and the flanges 34 and 35 are approximately 0.5 inches high.

Preferably, the body 15 includes a raised flange 30 for assuring uniform contact with the curtain hooks 23 as the corner support 12 is moved inwardly along the shower rod 32. The flange 30 prevents the hooks 23 from becoming entangled with the body 15.

With reference to FIG. 2, the parallel strips 20 and 21 depend downwardly from the body 15. They form a channel 22 through which the upper edge 26 of the outer shower curtain 25 passes as it extends toward the hook 29. The hook 29 extends inwardly from strip 20 to capture the eyelet 37 adjacent to the edge of the outer decorative shower curtain 25. An outer wand 91 may also be suspended from the hook 29.

With reference to FIGS. 2–4, the inwardly disposed beam 36, comprised of support arm 17, elbow 18, and arced bar or arm 19, is cantilevered from the inner parallel strip 21 from a medial point along the body 15. The support arm 17 extends inwardly from the inner strip 21 at approximately a 45° angle. In the preferred embodiment, the support arm 17 is approximately three inches in length between strip 21 and elbow 18. Arced bar 19 extends from elbow and then curves away from the shower curtain rod 32 and into the shower enclosure. In the preferred embodiment, arced bar 19 is approximately twelve inches in length. Parallel strips 20 and 21, arm 17 and arced bar 19 have a vertical dimension of approximately one inch.

Preferably, the shower curtain liner 24 is provided with a narrow sleeve 27 along its top edge. Bar 19 is inserted into the sleeve 27 through opening 30. As a result, the shower curtain liner 24 will hang vertically on a inwardly directed curve defined by the arced bar 19, adjacent to one of the vertical walls 14. It is preferred that the liner 24 be specifically configured for this purpose. As is common in the art, the remainder of shower curtains 24 and 25 is suspended from standard shower curtain hooks 23.

Preferably, an interior wand arrangement 80 is affixed to the shower curtain corner support 12. The wand arrangement 80 is comprised of an interior wand 83 that depends from support plate 81, which is attached above the elbow 18. A center aperture 82 is provided in plate 81 so that the end of the wand 83 may extend up through the plate 81. The wand 83 is retained in the aperture 82 via utilization of the washer 85 and retainer clip 86.

The shower curtain rod 32 is attached to the vertical walls 14, as shown in FIG. 1, on either side of the shower enclosure by keyed wall attachments 50. The corner supports 12 and 13 are installed on the shower curtain rod 32 prior to affixing the shower curtain rod 32 to the walls. Each wall attachment 50 is comprised of a base plate 52 to which a collar 56 is attached. Aperture 58 has an inner diameter slightly greater than the outer diameter of curtain rod 32. The keyed projection 54 extends into aperture 58. The keyed projection 54 aligns with the slot 33 and prevents rotation of the shower curtain rod 32 relative to the wall attachment 50. Apertures 60 are provided through the base plate 52 to affix the wall attachment 50 to one of the walls 14 defining the shower enclosure.

Referring to FIG. 1, after entering the shower enclosure, the user utilizes wand 83 to slide the corner supports 12 and 13, along with the attached curtains 24 and 25, toward opposite ends of the rod 32. The inward curved portions of the shower curtain liner 24 serve as a barrier to prevent shower spray from escaping around the outer edges of the enclosure. The corner supports 12 and 13, along with the curtains, 24 and 25 can be slid along the rod 32 utilizing wand 83 from either end to open the shower enclosure to allow a user to enter or exit. Throughout the movement of the shower curtains and their use, the upper edge of the curtain remains in substantially the same plane along the width of the curtain.

Referring again to FIG. 2, the moment created by the weight of the beam 36 and the inner curtain liner 24 is transferred from the corner support 12 to the curtain rod 32 by projection 44. The shower curtain rod 32 transmits the moment as torque to the keyed wall attachments 50 at each end. The torque in the curtain rod 32 is transferred to the keyed projection 54. The torque is then taken out into the wall 14 of the shower enclosure by fasteners (not shown) in apertures 60.

As illustrated in FIG. 2, it is preferred that the apertures 60 are spaced a sufficient distance from the curtain rod 32 to reduce the load transmitted to the wall. In the preferred embodiment, the distance between each mounting aperture 60 and the curtain rod aperture 58 is approximately two inches.

Figure 5:
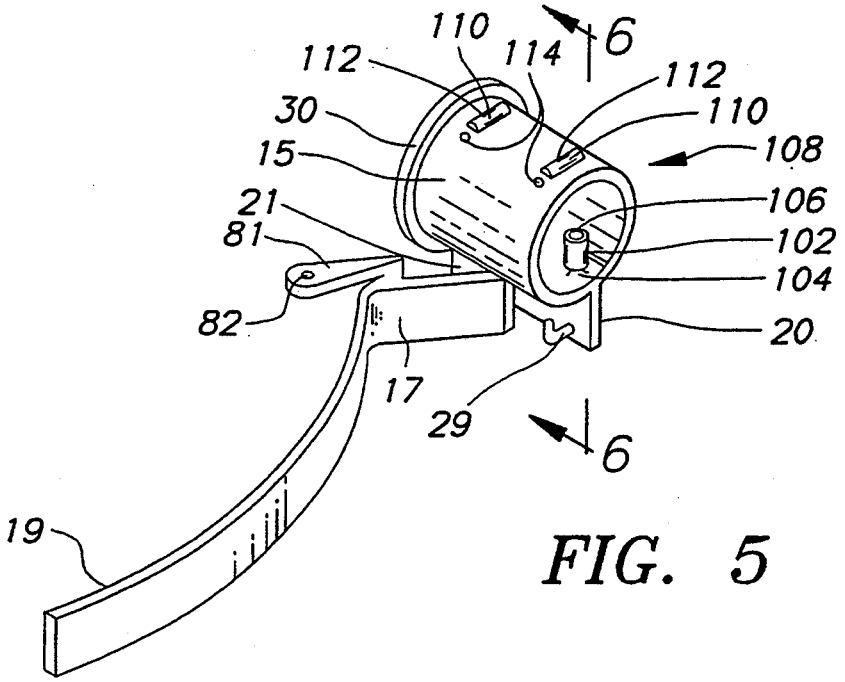
FIG. 5 is a perspective view of a second embodiment of the invention.
Figure 6:
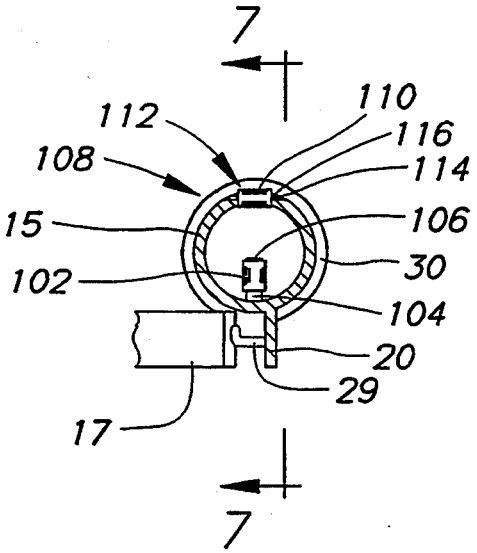
FIG. 6 is a section view along line 6—6 in FIG. 5.
Figure 7:
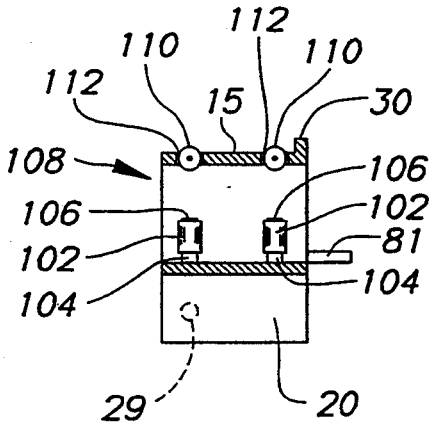
FIG. 7 is a section view along lines 7—7 in FIG. 6.

Referring to FIGS. 5 through 7, a second embodiment 108 of the corner support is shown. This second embodiment is similar to the first embodiment and like numerals indicate like elements. In this embodiment, projection 44 of the first embodiment has been replaced with rollers 102 to reduce sliding friction. Rollers 102, mounted on pins 104, extend into the hollow cylindrical body 15 in a complimentary position to the slot 33 in the shower curtain rod 32. Caps 106 are affixed to the top of pins 104 to maintain the rollers 102 in position. In addition, the knife edge 42 has been replaced with horizonal rollers 110 which are installed in two positions along the top of the body 15. The horizontal rollers 110 are installed in a pair of rectangular slots 112 formed in the top of the body 15 in a direction normal to the direction of travel of the corner support 108 along the shower curtain rod 32. Apertures 114 pierce, the cylindrical body 15 along the center line of each slot 112. The rollers 110 are positioned in the slots 112 and held in position with axial pins 116, installed through the apertures 114 and each rollers 110. The horizontal rollers contact the top of the curtain rod 32 providing easier movement of the corner support 108 along the shower curtain rod by reducing friction between the corner support 108 and the rod 32.

Corner support 108 operates in the same manner as the previous embodiment. The moment created by the weight of the inner shower curtain liner 24 and the inner beam 36 is transferred through the rollers 102 to the shower curtain rod 32.

Figure 8:
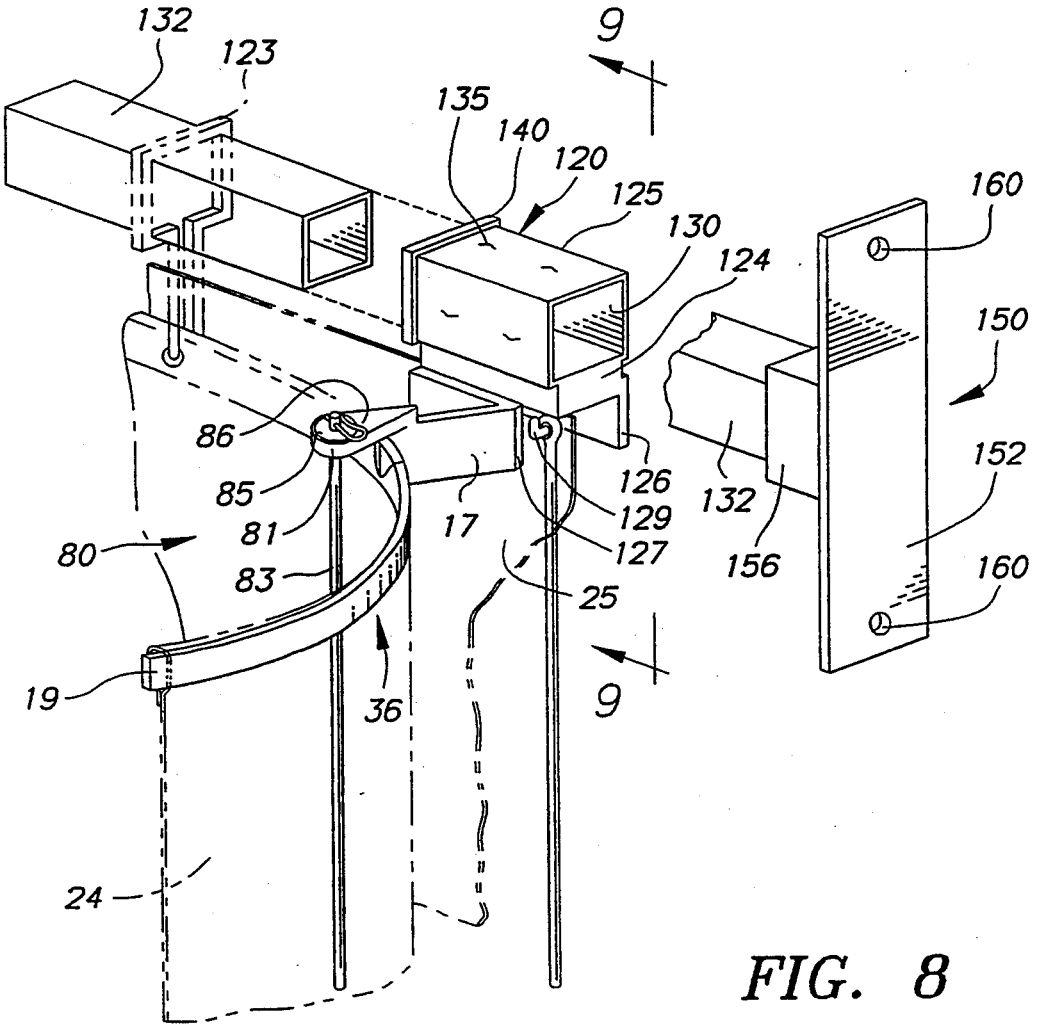
FIG. 8 is a perspective view of a third embodiment of the invention.
Figure 9:
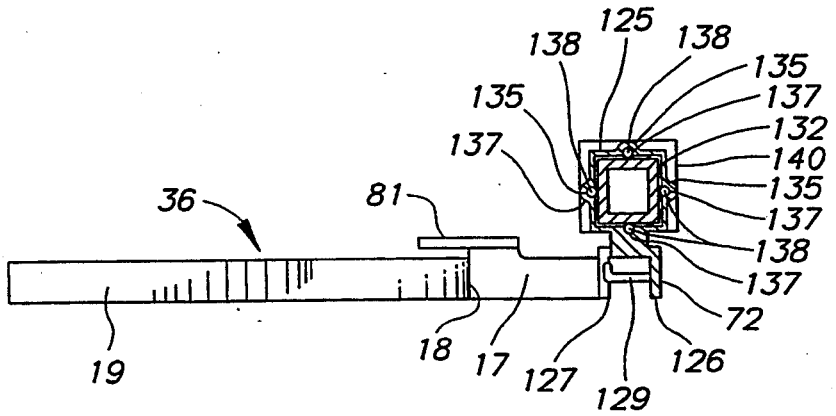
FIG. 9 is a section view along line 9—9 in FIG. 8.

A third embodiment of the invention is shown in FIGS. 8 and 9. The corner support 120 is comprised of a body 124 upon which a hollow sleeve 125 is mounted. The shower curtain rod 132 has a rectangular cross section and the sleeve 125 has a rectangular opening 130 designed for a clearance fit over the rod 132. A raised flange 140 is formed on the sleeve 125 to assure uniform contact with the shower curtain hangers 123. Parallel strips 126 and 127 depend downwardly from the body 124 in a similar manner to the parallel strips 20 and 21 described in the prior embodiments. A hook 129 protrudes from the outer parallel strip 126 to support the outer decoration shower curtain 25 and the external wand 91.

The corner support 120 relies on the shape of the shower curtain rod 132 and the complimentary shape of the sleeve 125 to transfer the moment generated by the weight of the beam 36 and the inner shower curtain liner 24 to the shower curtain rod 132.

Bearing supports 135 are located on each face of the sleeve 125. A bearing seat 137, which intersects the inside of sleeve 125, is located in each bearing support 135. Ball bearings 138 are installed in the bearing seats 137. The ball bearings 138 rotate freely in the bearing seats 137 and protrudes from the outer parallel strip 127 beyond the inside of the sleeve 125 to contact the outside of shower curtain rod 132 to reduce sliding friction.

A wall attachment 150 is used to secure each end of the curtain rod 132 to the vertical walls on either side of the shower enclosure. The wall attachment 150 is comprised of a base 152 to which a rectangular shaped collar 156 is attached. The inside of the collar 156 is complementarily configured to match the rectangular cross section of the shower curtain rod 132. Apertures 160 are defined through the base 152 for mounting the wall attachment to the shower enclosure walls.

The corner support 120 is used in a similar manner to the previously described embodiments of the invention. The moment generated by the weight of the beam 36 and the inner shower curtain liner 24 is transferred to the shower curtain rod 132 by the sleeve 125 acting on the non-circular cross section of the rod 132. The moment is transferred as torque to the wall attachments 150 on either end of the rod 132 and taken out in the shower enclosure walls.

As will be appreciated by those skilled in the art, a bearing liner may be incorporated inside the sleeve 125 in place of the bearings and bearing supports. Depending on the material used to make the sleeve 125, there may be no requirement for additional material or bearings for reducing friction between the sleeve 125 and the curtain rod 132. Additionally, various cross sections can be used for the sleeve 125 and the curtain rod 132 in order to prevent the corner support from rotating about the curtain rod.

It will be recognized by those skilled in the art that the disclosed shower curtain corner supports are the presently preferred embodiments and are susceptible to various modifications, changes and adaptations without departing from the scope of the present invention.

I claim:

1. An improved curtain corner support in combination with a curtain rod which spans an opening defined between vertical walls of an enclosure, the corner support positions an end portion of a curtain so that it is adjacent to one of the vertical walls, wherein the improvement is characterized by:

a body member supported for movement along the curtain rod which has an axis parallel to the curtain rod;

a beam cantilevered from the body member, with a central portion which extends away from the body member and a free end, which is generally perpendicular to the axis of the body member, which supports the end portion of the curtain;

moment transferring means for transferring a moment generated by the end portion of the curtain and the beam from the body member to the curtain rod to prevent the body member from rotating about the curtain rod; and attachment means affixed to at least one curtain rod end for transferring torque from the curtain rod to at least one of the vertical walls of the enclosure to maintain the inner beam in an approximately horizontal plane.

2. The apparatus of claim 1 wherein the moment transferring means is comprised of a projection on the body member located in a complementary position to a channel in the curtain rod.

3. The apparatus of claim 2 wherein the moment transferring means is comprised of the curtain rod having a non-circular cross section and the body member having a complementary shaped sleeve portion through which the curtain rod passes.

4. An improved shower curtain corner support in combination with a shower curtain rod which spans an opening defined between vertical walls of a shower enclosure, the corner support positions an end portion of a shower curtain so that it is adjacent to one of the vertical walls, wherein the improvement is characterized by:

a body member supported for movement along the curtain rod which has an axis parallel to the curtain rod;

a beam cantilevered from the body member, with a central portion which extends away from the body member and a free end, which is generally perpendicular to the axis of the body member, which supports the end portion of the shower curtain;

moment transferring means for transferring a moment generated by the end portion of the shower curtain and the beam from the body member to the curtain rod to prevent the body member from rotating about the curtain rod; and attachment means affixed to at least one curtain rod end for transferring torque from the curtain rod to at least one of the vertical walls of the shower enclosure to maintain the inner beam in an approximately horizontal plane.

5. The apparatus of claim 4 wherein the moment transferring means is comprised of a projection on the body member located in a complementary position to a channel in the curtain rod.

6. The apparatus of claim 5 wherein the moment transferring means is comprised of the curtain rod having a non-circular cross section and the body member having a complementary shaped sleeve portion through which the curtain rod passes.

* * * * *